US007584686B2

(12) United States Patent
Tsai

(10) Patent No.: US 7,584,686 B2
(45) Date of Patent: Sep. 8, 2009

(54) QUICK RELEASE MECHANISM FOR SOCKET WRENCH

(76) Inventor: Cheng Chang Tsai, No. 200, Chengong Road, Taiping City, Taichung 41166 (TW)

( * ) Notice: Subject to any disclaimer, the term of this patent is extended or adjusted under 35 U.S.C. 154(b) by 95 days.

(21) Appl. No.: 11/986,721

(22) Filed: Nov. 26, 2007

(65) Prior Publication Data

US 2009/0133538 A1 May 28, 2009

(51) Int. Cl.
*B25B 13/46* (2006.01)

(52) U.S. Cl. ..... 81/60; 81/177.85

(58) Field of Classification Search ..... 81/177.85, 81/60–63.2

See application file for complete search history.

(56) References Cited

U.S. PATENT DOCUMENTS

| | | | | |
|---|---|---|---|---|
| 3,762,245 | A | 10/1973 | Smyers et al. | 81/177 G |
| 4,187,747 | A | 2/1980 | Pawlow | 81/177 G |
| 4,211,127 | A | 7/1980 | D'Oporto et al. | 81/63 |
| 4,491,043 | A | 1/1985 | Dempsey et al. | 81/58 |
| 4,497,227 | A | 2/1985 | Stasiek | 81/63.1 |
| 6,109,140 | A * | 8/2000 | Roberts et al. | 81/63 |
| 6,551,118 | B2 | 4/2003 | Langolf et al. | |
| 6,623,286 | B2 | 9/2003 | Tachi | |
| 6,733,313 | B2 | 5/2004 | Shinozaki et al. | |
| 6,736,034 | B1 * | 5/2004 | Gonzales | 81/177.85 |
| 6,755,674 | B2 | 6/2004 | Fujii et al. | |
| 2002/0004326 | A1 | 1/2002 | Mochizuki | |
| 2002/0019156 | A1 | 2/2002 | Fukamachi et al. | |
| 2003/0162427 | A1 | 8/2003 | Shinozaki et al. | |
| 2003/0199185 | A1 | 10/2003 | Fujii et al. | |
| 2006/0144196 | A1 * | 7/2006 | Lee | 81/63 |
| 2007/0199412 | A1 * | 8/2007 | Lee | 81/177.85 |

FOREIGN PATENT DOCUMENTS

| | | |
|---|---|---|
| GB | 2 322 242 | 8/1998 |
| JP | 2001-326024 | 11/2001 |

* cited by examiner

*Primary Examiner*—D. S Meislin
(74) *Attorney, Agent, or Firm*—Charles E. Baxley

(57) ABSTRACT

A socket wrench includes a housing disposed in a driving head and having one or more protruded portions and one or more recessed portions, a gear rotatably received in the housing and having a driving stem, a detent slidably received in the driving stem and extendible into and out of the driving stem, a shaft slidably and rotatably received in the gear and having an actuating end for engaging with the detent, a follower attached to the shaft and having one or more protruded portions and one or more recessed portions for engaging with the protruded portions and the recessed portions of the housing and for actuating the actuating end of the shaft to engage with or to be disengaged from the detent.

12 Claims, 5 Drawing Sheets

QUICK RELEASE MECHANISM FOR SOCKET WRENCH

BACKGROUND OF THE INVENTION

1. Field of the Invention

The present invention relates to a socket wrench, and more particularly to a socket wrench including a quick release mechanism for detachably or quickly and effectively attaching or securing a socket member to the driving stem of the socket wrench.

2. Description of the Prior Art

Typical socket wrenches comprise an aperture formed through the driving head for slidably receiving a detent which may be used to lock a socket to the driving head, and a push bar attached or coupled to the detent and movable to allow retraction of the detent and release of the socket.

For example, U.S. Pat. No. 4,187,747 to Pawlow, U.S. Pat. No. 4,211,127 to D'Oporto et al., U.S. Pat. No. 4,491,043 to Dempsey et al., and U.S. Pat. No. 4,497,227 to Stasiek disclose four of the typical quick release mechanisms or reversible ratchet mechanisms for attaching or coupling to the socket wrenches, and a push bar or release shaft slidably received or engaged in a driving head of the socket wrench for detachably attaching or securing a socket member to the socket wrench.

However, the push bar or release shaft of the typical quick release mechanisms or reversible ratchet mechanisms may only be moved for a limited distance and may not be used to effectively actuate or operate the detent.

U.S. Pat. No. 3,762,245 to Smyers et al. discloses another typical quick release mechanism or quick release and speeder for attaching or coupling to the socket wrenches, and also including a push bar or release shaft slidably received or engaged in a driving head of the socket wrench for detachably attaching or securing a socket member to the socket wrench.

However, the push bar or release shaft of the typical quick release mechanism also may only be moved for a limited distance and may not be used to effectively or quickly actuate or operate the detent.

The present invention has arisen to mitigate and/or obviate the afore-described disadvantages of the conventional quick release mechanisms or reversible ratchet mechanisms for the socket wrenches.

SUMMARY OF THE INVENTION

The primary objective of the present invention is to provide a socket wrench including a quick release mechanism for detachably or quickly and effectively attaching or securing a socket member to the driving stem of the socket wrench.

In accordance with one aspect of the invention, there is provided a socket wrench comprising a driving head including a chamber formed therein, a housing disposed in the chamber of the driving head, and including a compartment formed in the housing, and including a central hole formed therein and communicating with the compartment of the housing, and including an upper portion, and including a curved surface formed in the upper portion of the housing and having at least one protruded portion and at least one recessed portion, a gear rotatably received in the compartment of the housing for being selectively rotated by the housing and the driving head, and including a driving stem extended therefrom, and including a bore formed in the driving stem, and including an orifice formed in the driving stem and communicating with the bore of the gear, a detent slidably received in the orifice of the driving stem and extendible selectively into and out of the driving stem, a shaft slidably and rotatably received in the bore of the gear, and including an actuating end for engaging with the detent and for selectively moving the detent into and out of the driving stem, and including a driven end provided thereon, a spring biasing device for biasing the actuating end of the shaft to engage with the detent, and a follower attached to the shaft and to be rotated relative to the housing by the shaft, and including a curved surface formed in the follower and having at least one protruded portion and at least one recessed portion for engaging with the protruded portion and the recessed portion of the housing respectively, the protruded portion of the follower is engageable with the recessed portion of the housing, and the recessed portion of the follower is engageable with the protruded portion of the housing for allowing the actuating end of the shaft to be biased to engage with the detent and to move the detent out of the driving stem, and the protruded portion of the follower is engageable with the protruded portion of the housing when the follower is rotated relative to the housing by the shaft, for allowing the actuating end of the shaft to be disengaged from the detent and to be selectively moved into the driving stem.

The housing includes a swelling extended upwardly from the upper portion of the housing, and the curved surface of the housing is formed in the swelling. The housing includes a central hole formed therein and located in the swelling, and communicating with the compartment of the housing for slidably and rotatably receiving the shaft.

The detent includes a cavity formed therein for receiving and engaging with the actuating end of the shaft. The cavity of the detent and the actuating end of the shaft include a cone-shape, or a frustum-shape or the like.

The shaft includes an anchor pin engaged through the driven end of the shaft and engaged with the follower for anchoring and positioning the follower to the shaft. The follower includes a depression formed therein for engaging with the anchor pin.

The driving head includes a knob rotatably attached to the driving head and attached to the driven end of the shaft for rotating the shaft relative to the housing and the driving head. The knob includes a stud extended therein and having a recess formed therein for slidably receiving the driven end of the shaft.

The driving head includes a casing attached to the driving head and having a peripheral flange extended radially and inwardly therefrom, and the knob includes a peripheral groove formed therein for engaging with the peripheral flange of the casing and for allowing the knob to be rotatably attached to the driving head. The driving head includes an upwardly extended barrel, and the casing is secured to the barrel of the driving head.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
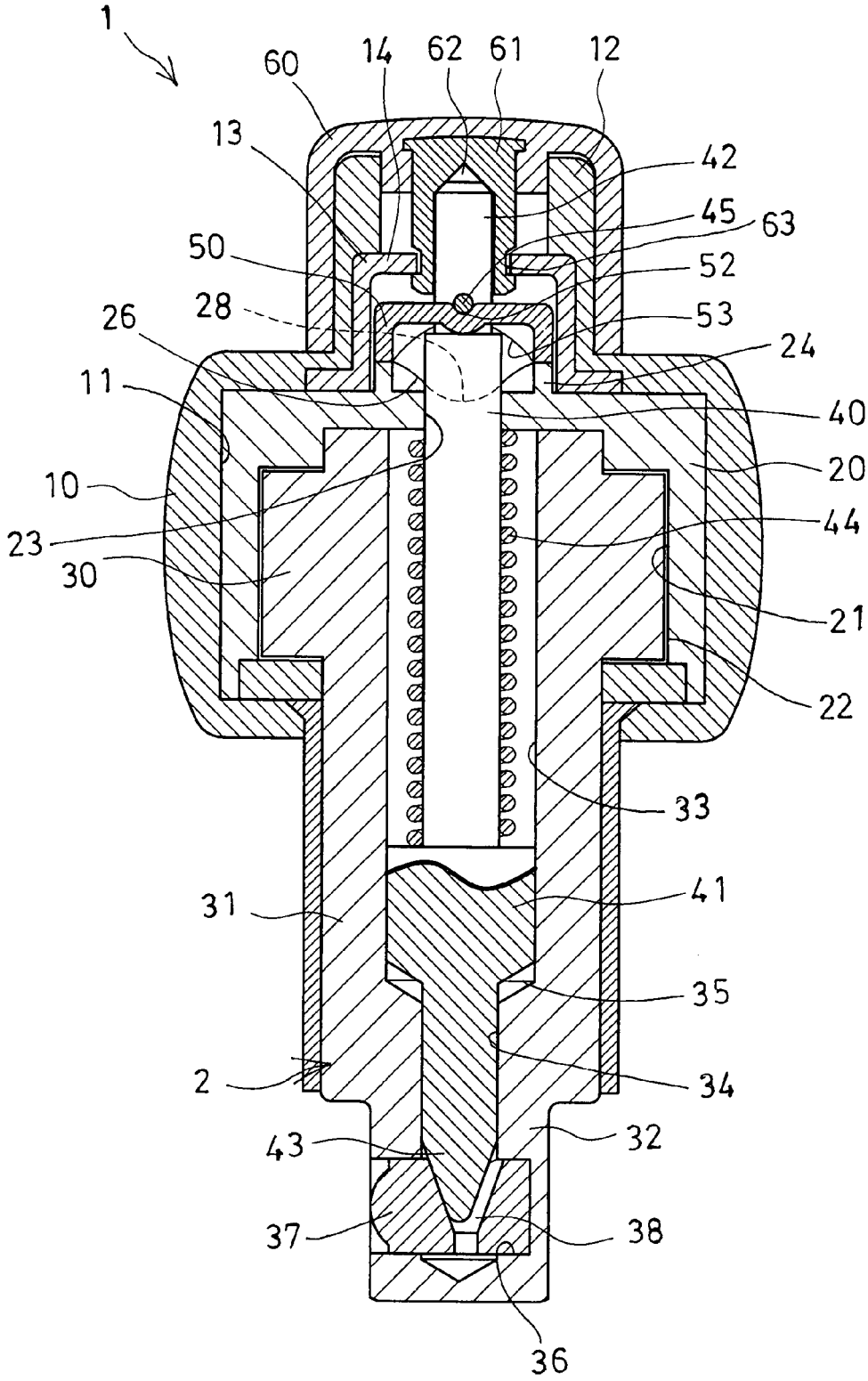
FIG. 1 is a cross sectional view of a socket wrench in accordance with the present invention.
Figure 2:
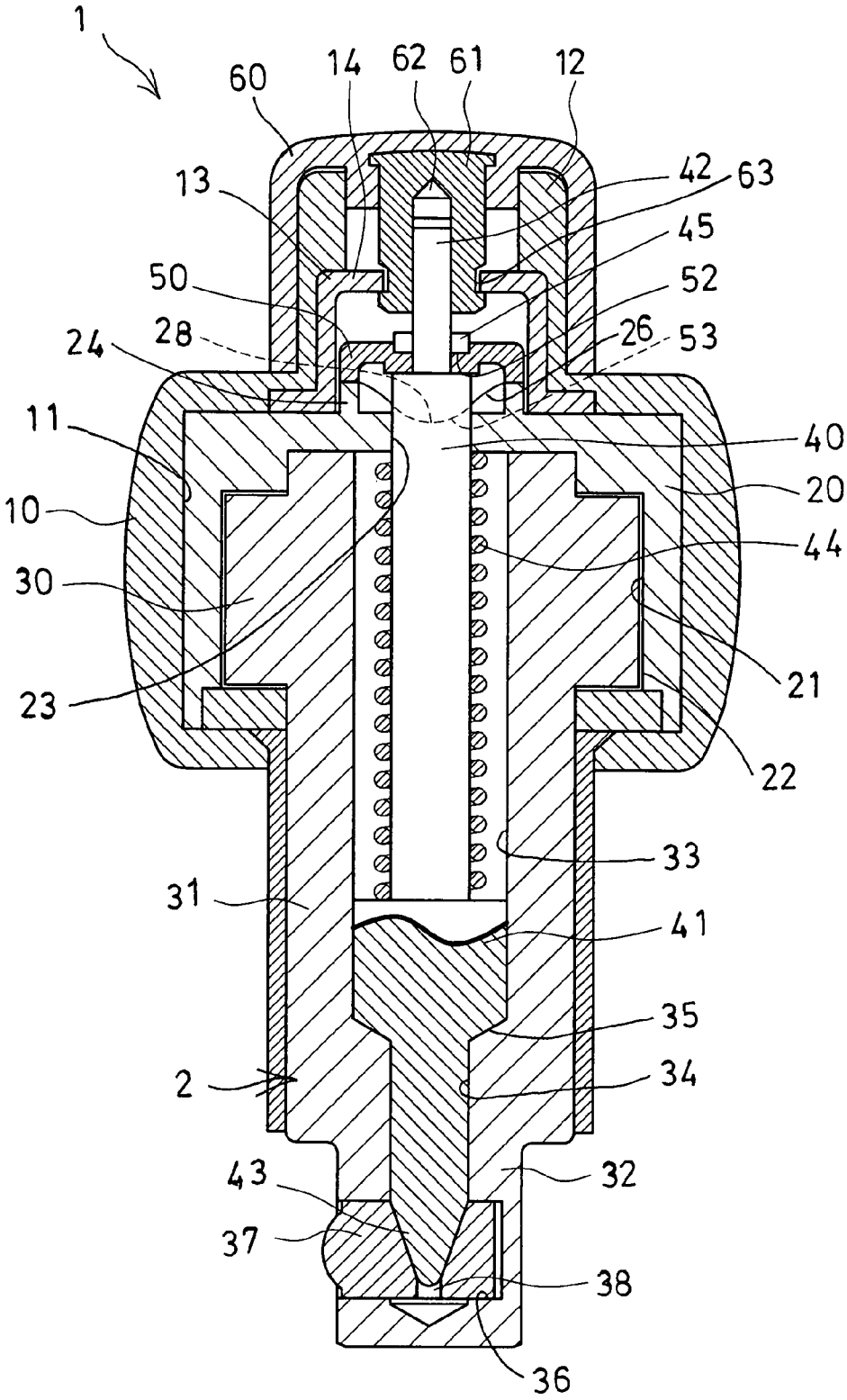
FIG. 2 is a cross sectional view similar to FIG. 1, illustrating the operation of the socket wrench.

Referring to the drawings, and initially to FIGS. 1-2, a socket wrench 1 in accordance with the present invention comprises a driving head 10 formed or provided on one end portion of a handle member (not shown), and the driving head 10 includes a chamber 11 formed therein for slidably receiving a ratchet mechanism 2 therein, for example, the ratchet mechanism 2 includes a cartridge or housing 20 (FIGS. 1-5) disposed or engaged in the chamber 11 of the driving head 10, and having a compartment 21 formed in the housing 20, and having an internal gear 22 formed or provided in the compartment 21 or in the inner portion of the housing 20, and a gear 30 rotatably received or engaged in the compartment 21 of the housing 20 and arranged for allowing the gear 30 to be rotated or driven by the housing 20 and the driving head 10 and the handle member (not shown).

The gear 30 includes an extension 31 extended downwardly therefrom, and a driving stem 32 extended downwardly from the extension 31 and having a non-circular cross section for engaging with the typical socket members (not shown) and for rotating or driving the typical socket members, and includes a bore 33 formed in the central portion of the gear 30 and/or the extension 31, and includes a narrowed or diameter reduced passage 34 formed in the central portion of the extension 31 and/or the driving stem 32 and communicating with the bore 33 of the gear 30 for forming an annular or peripheral shoulder 35 between the bore 33 and the passage 34 of the gear 30, and includes an orifice 36 laterally formed in the driving stem 32 and communicating with the bore 33 or the passage 34 of the extension 31 of the gear 30 for slidably receiving a rounded detent 37.

Figure 5:
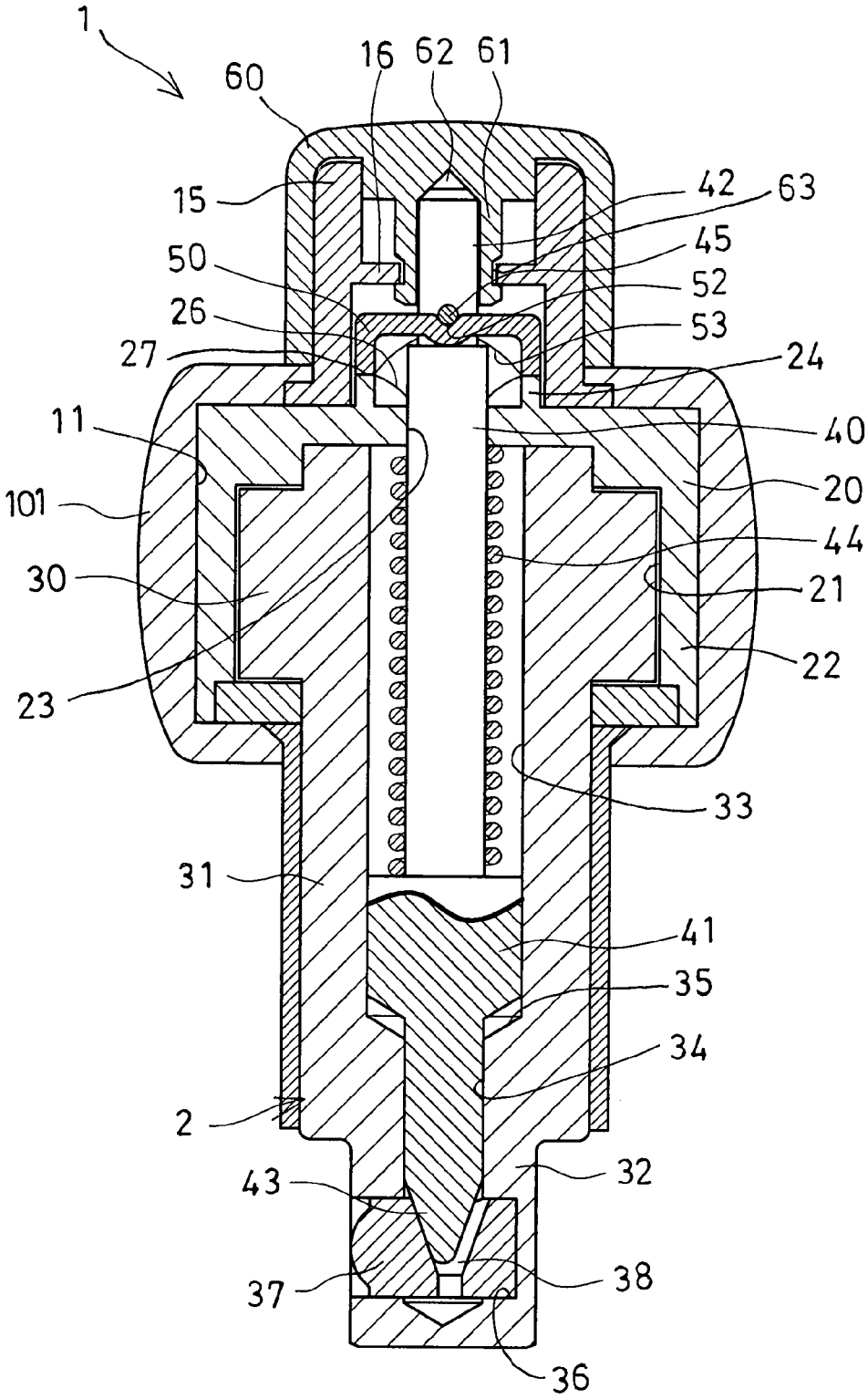
FIG. 5 is a cross sectional view similar to FIGS. 1 and 2, illustrating the other arrangement of the socket wrench.

The detent 37 is arranged to be selectively moved or extended out of the driving stem 32 for engaging with the socket members to be driven and for detachably attaching or securing the socket members to the driving stem 32 of the socket wrench 1, and is also arranged to be selectively retracted or engaged into the orifice 36 of the driving stem 32 for being disengaged from the socket members and thus for allowing the socket members to be engaged onto or disengaged from the driving stem 32. The detent 37 includes a cavity 38 formed therein, such as formed in the upper portion thereof for aligning with or directing toward or communicating with the passage 34 of the extension 31 of the gear 30, and the cavity 38 of the detent 37 includes a cone-shape or frustum-shape having a peripheral or inclined surface formed therein (FIGS. 1-2, 5). The above-described structure is typical and will not be described in further details.

The housing 20 includes a central hole 23 formed therein and communicating with the compartment 21 of the housing 20 for slidably and rotatably receiving a release or elongate shaft 40, in which the shaft 40 includes a circular cross section for being slidably and rotatably received and engaged in the central hole 23 of the housing 20 and the passage 34 of the extension 31 of the gear 30, and the shaft 40 includes an enlarged block 41 formed or provided on the middle portion of the shaft 40 and also having a circular cross section for being slidably and rotatably received and engaged in the bore 33 of the gear 30 for engaging with the shoulder 35 of the gear 30 and for limiting the block 41 and the shaft 40 to slide relative to the gear 30 and the detent 37. The shaft 40 includes a bar or driven end 42 extended upwardly from the shaft 40 or provided on the upper portion of the shaft 40 and having a non-circular or square or rectangular cross section.

The shaft 40 includes a tapered or inclined or cone-shaped or frustum-shaped lower or actuating end 43 for engaging with the cavity 38 of the detent 37 and for selectively moving the detent 37 out to engage with the socket members or for selectively retracting or engaging the detent 37 into the orifice 36 of the driving stem 32 and disengaged from the socket members. A spring biasing means or member 44 is engaged onto the outer peripheral portion of the shaft 40 and engaged between the housing 20 and the block 41 of the shaft 40 for forcing or biasing the actuating end 43 of the shaft 40 to engage with the detent 37 and for selectively moving the detent 37 into or out of the orifice 36 of the driving stem 32, and preferably for forcing the actuating end 43 of the shaft 40 to move the detent 37 out of the driving stem 32 and to engage with the socket members.

The housing 20 includes a bulge or swelling 24 extended upwardly from the upper portion 25 of the housing 20 (FIGS. 3, 4), and preferably formed or provided above the central hole 23 of the housing 20, or having the central hole 23 formed or located in the center portion of the swelling 24 of the housing 20 (FIGS. 1-2, 5), and includes a wave-shaped or curved surface 26 formed or provided in the upper portion of the swelling 24 and having one or more (such as two) upper or higher or protruded portions 27 and one or more (such as two) lower or recessed portions 28. A follower 50 includes a non-circular aperture 51 formed therein for slidably receiving the non-circular bar or driven end 42 of the shaft 40 and for allowing the follower 50 to be attached to the shaft 40 and to be rotated or driven relative to the housing 20 by the shaft 40.

It is preferable that the follower 50 further includes a depression 52 formed therein, such as formed in the upper portion thereof, and an anchor pin 45 is engaged through the bar or driven end 42 or the shaft 40 and engaged with the depression 52 of the follower 50 for anchoring or positioning the follower 50 to the bar or driven end 42 or the shaft 40 and for preventing the follower 50 from being disengaged from the shaft 40, and the spring biasing member 44 may force or bias the follower 50 toward or to engage with the swelling 24 of the housing 20. The follower 50 also includes a wave-shaped or curved surface 53 formed or provided in the lower portion thereof and having one or more (such as two) recessed portions 54 and one or more (such as two) protruded portions 55 for engaging with the protruded portions 27 and the recessed portions 28 of the swelling 24 or of the housing 20 respectively.

Figure 3:
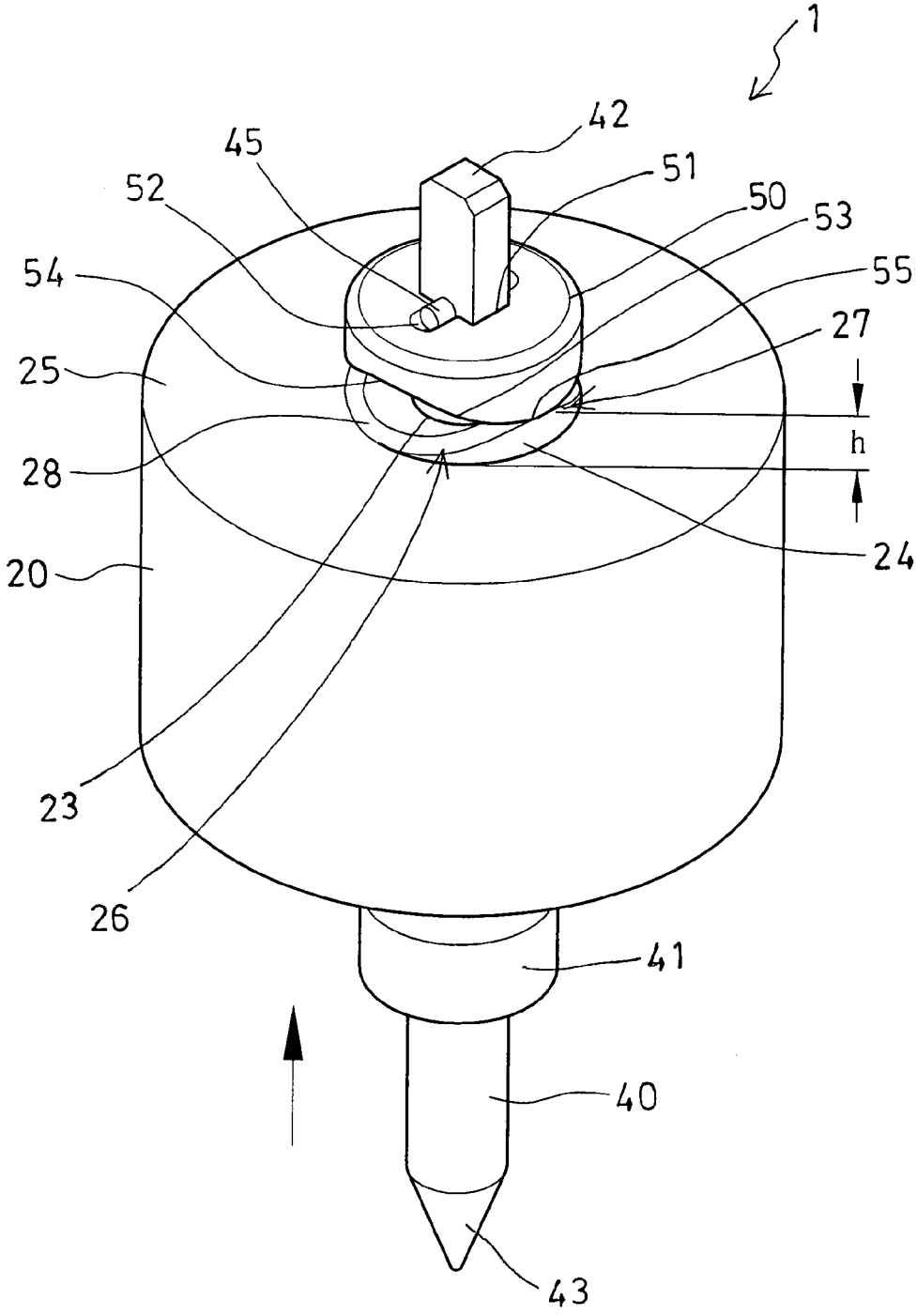
FIG. 3 is a perspective view illustrating a quick release mechanism for the socket wrench.

For example, as shown in FIGS. 1, 3, when the protruded portions 27 of the swelling 24 or of the housing 20 are engaged with the protruded portions 55 of the follower 50, the follower 50 may be moved upwardly or away from the swelling 24 of the housing 20 for a distance that doubles the height "h" of the protruded portions 27 of the swelling 24 or of the housing 20 or of the protruded portions 55 of the follower 50. On the contrary, as shown in FIGS. 2, 4, when the protruded portions 27 of the swelling 24 or of the housing 20 are engaged with the recessed portions 54 of the follower 50, or when the recessed portions 28 of the swelling 24 or of the housing 20 are engaged with the protruded portions 55 of the follower 50, the follower 50 may be moved downwardly or toward the swelling 24 of the housing 20 for a distance that doubles the height "h" of the protruded portions 27 of the swelling 24 or of the housing 20 or of the protruded portions 55 of the follower 50.

Figure 4:
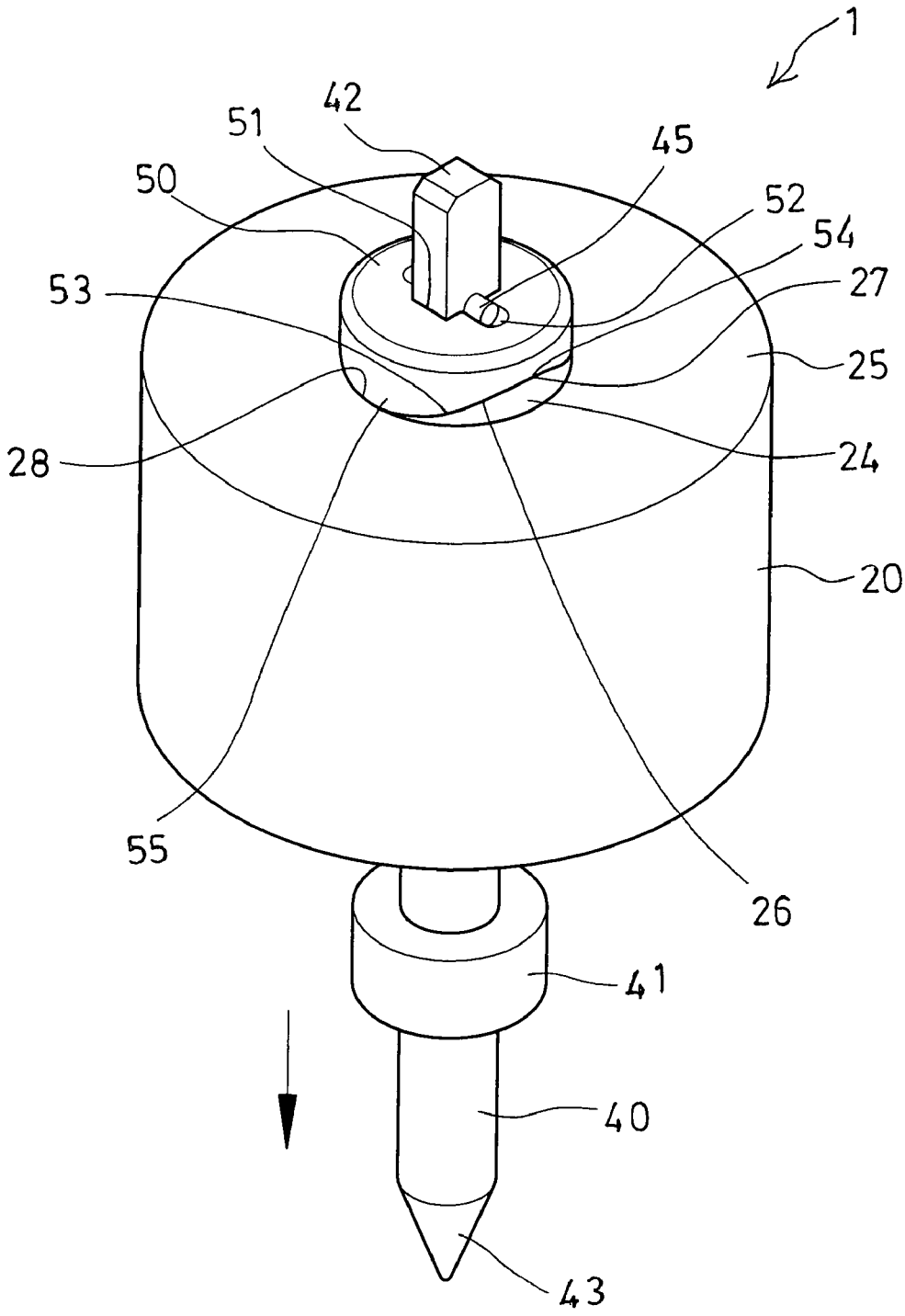
FIG. 4 is a perspective view similar to FIG. 3, illustrating the operation of the socket wrench.

In operation, when the protruded portions 27 of the swelling 24 or of the housing 20 are engaged with the recessed portions 54 of the follower 50, or when the recessed portions 28 of the swelling 24 or of the housing 20 are engaged with the protruded portions 55 of the follower 50, as shown in FIGS. 2, 4, the shaft 40 may be forced or biased or moved downwardly by the spring biasing member 44, and the actuating end 43 of the shaft 40 may be forced or actuated to engage with the detent 37 and to selectively move the detent 37 out of the driving stem 32 and to engage with the socket members. On the contrary, as shown in FIGS. 1, 3, when the protruded portions 27 of the swelling 24 or of the housing 20 are engaged with the protruded portions 55 of the follower 50, the shaft 40 may be caused or forced to move upwardly against the spring biasing member 44 to move the actuating end 43 of the shaft 40 upwardly or away from the detent 37 and to allow the detent 37 to be moved into the driving stem 32 and to be disengaged from the socket members.

As shown in FIGS. 1 and 2, the driving head 10 includes a barrel 12 extended upwardly therefrom and preferably formed integral with the driving head 10, and a casing 13 attached or secured in the barrel 12 or the driving head 10 with such as fasteners or latches (not shown), adhesive materials, or by welding processes, and includes an annular or peripheral flange 14 extended radially and inwardly therefrom, and a hand grip or button or knob 60 is rotatably attached or engaged onto the barrel 12 of the driving head 10, and includes a stud 61 extended therein and having a non-circular or square or rectangular recess 62 formed therein for slidably receiving the non-circular bar or driven end 42 of the shaft 40 and for allowing the shaft 40 and the follower 50 to be rotated or driven by the knob 60 and for allowing the bar or driven end 42 of the shaft 40 to be slid or moved up and down along or relative to the recess 62 of the stud 61 or of the knob 60.

The knob 60 includes an annular or peripheral groove 63 formed therein for receiving or engaging with the peripheral flange 14 of the driving head 10, and for allowing the knob 60 to be rotatably attached or engaged onto the barrel 12 of the driving head 10, and for allowing the bar or driven end 42 of the shaft 40 to be rotated or driven by the knob 60 and thus for allowing the bar or driven end 42 of the shaft 40 and the follower 50 to be forced to slide or to move up and down relative to the swelling 24 of the housing 20. It is to be noted that the follower 50 may be moved upwardly or away from the swelling 24 of the housing 20, or downwardly or toward the swelling 24 of the housing 20 for a distance that doubles the height "h" of the protruded portions 27 of the swelling 24 or of the housing 20 or of the protruded portions 55 of the follower 50, and thus for allowing the shaft 40 to be easily rotated or driven by the knob 60.

Alternatively, as shown in FIG. 5, the driving head 101 may include a barrel 15 separated from the driving head 101 and attached or secured to the driving head 101 with such as fasteners or latches (not shown), adhesive materials, or by welding processes, and includes an annular or peripheral flange 16 extended radially and inwardly therefrom for receiving or engaging with the peripheral groove 63 of the knob 60 and for allowing the knob 60 to be rotatably attached or engaged onto the barrel 15 of the driving head 101, and for allowing the shaft 40 to be rotated or driven by the knob 60 and thus for allowing the shaft 40 and the follower 50 to be forced to slide or to move up and down relative to the swelling 24 of the housing 20.

Accordingly, the socket wrench in accordance with the present invention includes a quick release mechanism for detachably or quickly and effectively attaching or securing the socket member to the driving stem of the socket wrench.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A socket wrench comprising:

a driving head including a chamber formed therein, a housing disposed in said chamber of said driving head, and including a compartment formed in said housing, and including a central hole formed therein and communicating with said compartment of said housing, and including an upper portion, and including a curved surface formed in said upper portion of said housing and having at least one protruded portion and at least one recessed portion, a gear rotatably received in said compartment of said housing for being selectively rotated by said housing and said driving head, and including a driving stem extended therefrom, and including a bore formed in said driving stem, and including an orifice formed in said driving stem and communicating with said bore of said gear, a detent slidably received in said orifice of said driving stem and extendible into and out of said driving stem, a shaft slidably and rotatably received in said bore of said gear, and including an actuating end for engaging with said detent and for selectively moving said detent into and out of said driving stem, and including a driven end provided thereon, means for biasing said actuating end of said shaft to engage with said detent, and a follower attached to said shaft and to be rotated relative to said housing by said shaft, and including a curved surface formed in said follower and having at least one protruded portion and at least one recessed portion for engaging with said at least one protruded portion and said at least one recessed portion of said housing respectively, said at least one protruded portion of said follower being engageable with said at least one recessed portion of said housing, and said at least one recessed portion of said follower being engageable with said at least one protruded portion of said housing for allowing said actuating end of said shaft to be biased to engage with said detent and to move said detent out of said driving stem, and said at least one protruded portion of said follower being engageable with said at least one protruded portion of said housing when said follower is rotated relative to said housing by said shaft, for allowing said actuating end of said shaft to be disengaged from said detent and to be selectively moved into said driving stem.

2. The socket wrench as claimed in claim 1, wherein said housing includes a swelling extended upwardly from said upper portion of said housing, and said curved surface of said housing is formed in said swelling.

3. The socket wrench as claimed in claim 2, wherein said housing includes a central hole formed therein and located in said swelling, and communicating with said compartment of said housing for slidably and rotatably receiving said shaft.

4. The socket wrench as claimed in claim 1, wherein said detent includes a cavity formed therein for receiving and engaging with said actuating end of said shaft.

5. The socket wrench as claimed in claim 4, wherein said cavity of said detent and said actuating end of said shaft include a cone-shape.

6. The socket wrench as claimed in claim 4, wherein said cavity of said detent and said actuating end of said shaft include a frustum-shape.

7. The socket wrench as claimed in claim 1, wherein said shaft includes an anchor pin engaged through said driven end of said shaft and engaged with said follower for anchoring and positioning said follower to said shaft.

8. The socket wrench as claimed in claim 7, wherein said follower includes a depression formed therein for engaging with said anchor pin.

9. The socket wrench as claimed in claim 1, wherein said driving head includes a knob rotatably attached to the driving head and attached to said driven end of said shaft for rotating said shaft relative to said housing and said driving head.

10. The socket wrench as claimed in claim 9, wherein said knob includes a stud extended therein and having a recess formed therein for slidably receiving said driven end of said shaft.

11. The socket wrench as claimed in claim 10, wherein said driving head includes a casing attached to said driving head and having a peripheral flange extended radially and inwardly therefrom, and said knob includes a peripheral groove formed therein for engaging with said peripheral flange of said casing and for allowing said knob to be rotatably attached to said driving head.

12. The socket wrench as claimed in claim 11, wherein said driving head includes an upwardly extended barrel, and said casing is secured to said barrel of said driving head.

* * * * *